US005598644A

United States Patent [19]

Polegato

[11] Patent Number: 5,598,644

[45] Date of Patent: Feb. 4, 1997

[54] WATERPROOF TRANSPIRING SOLE FOR FOOTGEAR

[75] Inventor: Mario M. Polegato, Crocetta Del Montello, Italy

[73] Assignee: Pol Scarpe Sportive S.r.l., Biadene Di Montebelluna, Italy

[21] Appl. No.: 542,467

[22] Filed: Oct. 12, 1995

Related U.S. Application Data

[63] Continuation of Ser. No. 200,330, Feb. 23, 1994, abandoned.

[30] Foreign Application Priority Data

Mar. 5, 1993 [IT] Italy ..... PD93A0051

[51] Int. Cl.[6] ..... A43B 7/06; A43C 15/02

[52] U.S. Cl. ..... 36/3 B; 36/30 R; 36/59 A

[58] Field of Search ..... 36/3 B, 3 R, 59 A, 36/30 R

[56] References Cited

U.S. PATENT DOCUMENTS

| | | | |
|---|---|---|---|
| 429,429 | 6/1890 | Eckhardt | 36/3 B |
| 997,657 | 7/1911 | Drake | 36/59 A X |
| 2,152,657 | 4/1939 | Montgomery . | |
| 2,327,360 | 11/1939 | Margolin | 36/30 A X |
| 2,844,833 | 7/1958 | Odermatt | 36/59 A X |
| 4,237,627 | 12/1980 | Turner | 36/3 B X |
| 4,819,345 | 4/1989 | Mulcahy et al. . | |
| 5,044,096 | 9/1991 | Polegato | 36/3 B X |

FOREIGN PATENT DOCUMENTS

| | | | |
|---|---|---|---|
| 0226948 | 7/1987 | European Pat. Off. . | |
| 0275644 | 7/1988 | European Pat. Off. . | |
| 0284638 | 10/1988 | European Pat. Off. . | |
| 0479183 | 4/1992 | European Pat. Off. . | |
| 0601278 | 7/1925 | France | 36/59 A |
| 2525614 | 12/1976 | Germany . | |
| 3005425 | 10/1980 | Germany . | |
| 8505944 | 8/1986 | Germany . | |
| 3507295 | 9/1986 | Germany | 36/28 |
| 4002667 | 6/1991 | Germany . | |

*Primary Examiner*—Ted Kavanaugh
*Attorney, Agent, or Firm*—Guido Modiano; Albert Josif

[57] ABSTRACT

Waterproof and transpiring sole for footgear including a tread made of leather or similar material which is at least partially covered, in an upward region, by a membrane made of vapor-permeable and waterproof material. The tread is assembled, at least along its perimeter, together with at least one upper part made of rubber or equivalent material which has a central opening in the region affected by the membrane.

16 Claims, 2 Drawing Sheets

WATERPROOF TRANSPIRING SOLE FOR FOOTGEAR

This is a continuation application of application Ser. No. 08/200,330 filed on Feb. 23, 1994, now abandoned.

BACKGROUND OF THE INVENTION

The present invention relates to a waterproof and transpiring sole for footgear.

As is known, the main problem observed in using footgear having a normal sole made of a natural material, such as leather or equivalent materials, is wet weather.

When rain and bad weather make the streets wet and slippery, it is in fact unadvisable to use footgear with leather soles, since the leather, indeed because it is vapor-permeable and healthy for the foot, is not waterproof but on the contrary absorbs water.

The thinner the leather, the faster it becomes impregnated with water or moisture until it wets the user's foot.

This drawback also combines with the fact that the leather tread has no pattern, is smooth, or often even polished with waxes.

This is an additional problem in wet weather, since grip is unreliable in such conditions.

Accordingly, use of soles with a leather tread is limited by weather conditions and for this reason footgear made of this kind of material is generally provided by manufacturers in the summer collections in countries where the dry season is predominant.

Up to now, this drawback has been obviated by inserting between the leather tread and the foot resting region a polyurethane or PVC element, which however inhibits transpiration and confines the use of leather to a mere aesthetic effect.

SUMMARY OF THE INVENTION

A principal aim of the present invention is to provide a sole that solves the drawbacks described above in known types of footgear with a leather tread.

A further aim is to provide a sole having also good characteristics of grip on the ground in all conditions of use.

Another aim of the present invention is to provide a sole having also shock-absorbing characteristics.

Another important aim is to provide a sole having the same advantages as those with a leather tread that are currently commercially available.

Another aim is to increase user comfort.

Another aim of the invention is to provide a sole that can be manufactured at a low cost and can thus be sold at a competitive price.

Another aim is to provide a sole that can be manufactured with known equipment and methods.

With this and other aims in view, there is provided, according to the present invention, a waterproof and transpiring sole for footgear, characterized in that it comprises a tread made of leather or of a similar material which is at least partially covered, in an upward region, by a membrane of vapor-permeable and waterproof material and is assembled, at least along its perimeter, together with at least one upper part made of rubber or equivalent material which has one or more through holes at least in the regions affected by said membrane.

BRIEF DESCRIPTION OF THE DRAWINGS

Further characteristics and advantages of the present invention will become apparent from the following detailed description of some preferred embodiments thereof, illustrated only by way of non-limitative example in the accompanying drawings, wherein.

DESCRIPTION OF THE PREFERRED EMBODIMENTS

Figure 1:
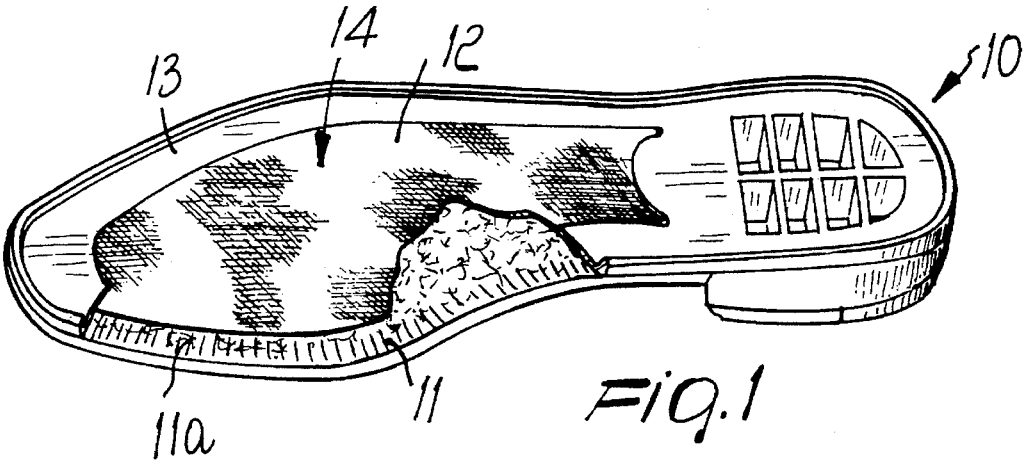
FIG. 1 is a partially sectional perspective view of a first embodiment of the sole.
Figure 2:
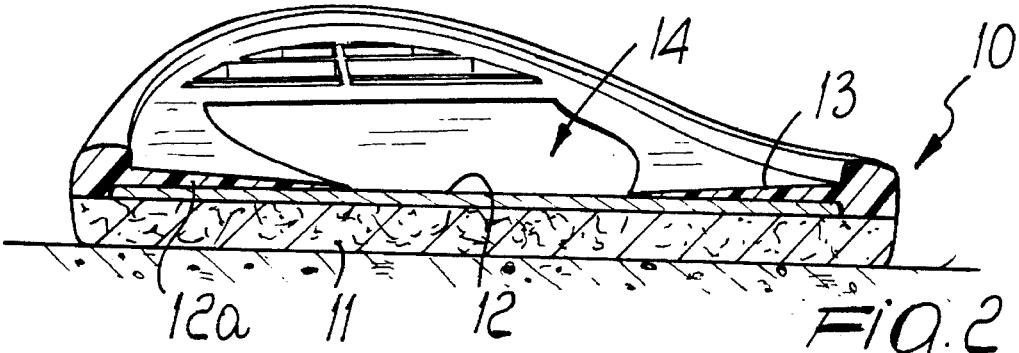
FIG. 2 is a perspective transverse sectional view of the sole of FIG. 1.

With reference to the above mentioned FIGS. 1 and 2, a first embodiment of the waterproof and transpiring or vapor-permeable sole for footgear is generally designated by the reference numeral 10 and comprises a tread 11 made of leather or similar material which is covered, in an upward region, substantially in the plantar region, by a membrane 12 which is impermeable and vapor-permeable and preferably made of a microporous waterproof material such as the one commonly termed Gore-Tex or another equivalent material.

The membrane 12 is spaced, along its perimeter, from the perimetric edge region **11*a* of the tread 11, and forms a monolithic body therewith, since it is joined to it by means of appropriate adhesives which are for example spread on it along its perimeter at the peripheral regions 12*a*** thereof.

An upper perimetric part 13 made of rubber, polyurethane, PVC or other equivalent material is assembled onto the tread 11, for example by injection-molding, and covers the peripheral regions of the membrane 12, leaving a wide central opening 14 at its tapered inner edges where said membrane is exposed.

The membrane 12 forms a barrier against water and moisture, but preserves the vapor-permeability characteristics given to the sole by the presence of the leather tread 11. Thus water is prevented from passing from the bottom and through the sole while vapor can pass from the top and through the sole.

Figure 3:
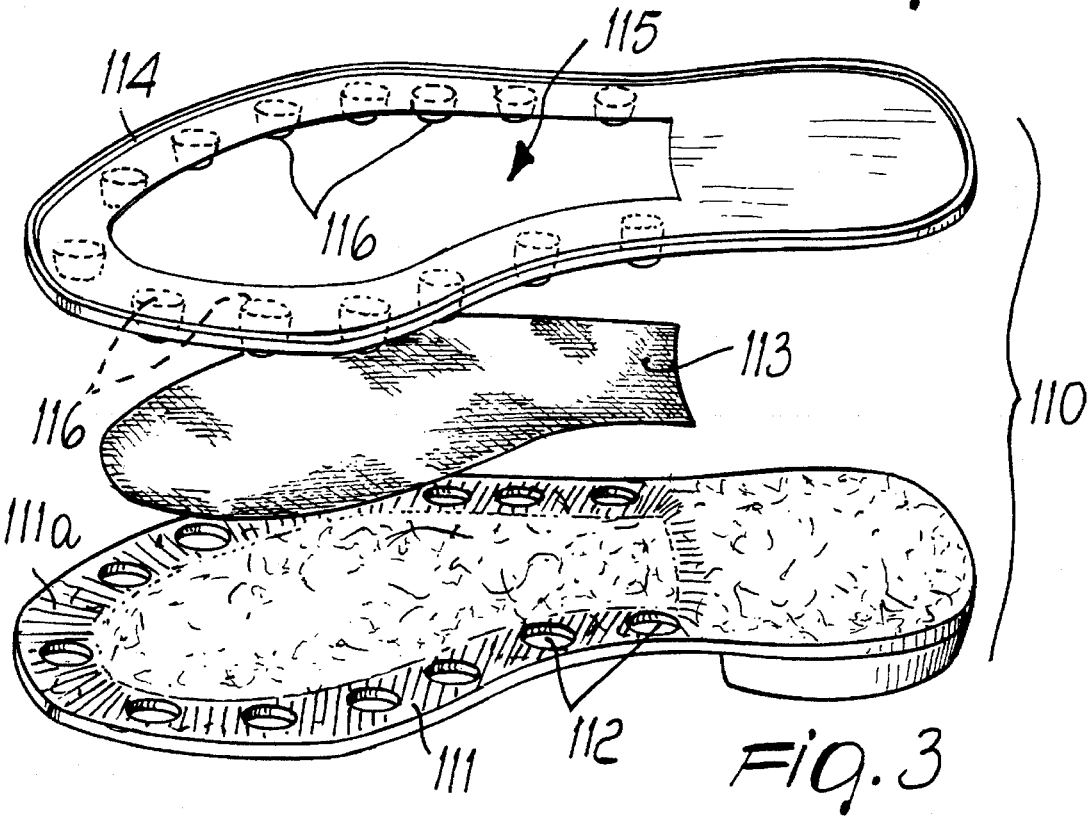
FIG. 3 is a perspective exploded view of a second embodiment of the sole.
Figure 4:
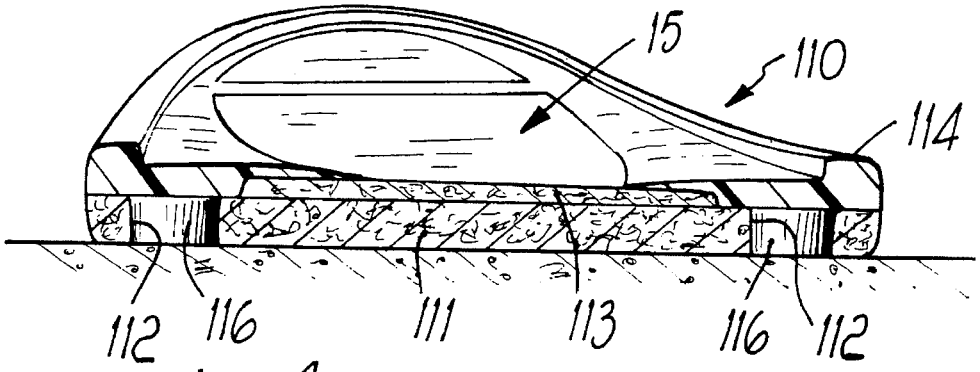
FIG. 4 is a perspective transverse sectional view of the sole of FIG. 3 in assembled condition.

With reference now to the above mentioned FIGS. 3 and 4, in a second embodiment the sole is generally designated by the reference numeral 110 and comprises a tread 111 made of leather or similar material which is provided with through holes 112 in a perimetric region **111*a***.

The tread 111 is covered, in a region that lies inward with respect to the holes 112, by a membrane 113, similar to the previously mentioned membrane 12, which is joined thereto by means of appropriate adhesives.

In an upward region, a perimetric part 114 made of rubber, polyurethane, TR, PVC or equivalent material is assembled together with the tread 111, for example by injection molding, and encloses the edges of the membrane 113, leaving a wide central opening 115 in which said membrane is exposed.

Said part 114 has studs 116 that fill the through holes 112 and, if the part is manufactured by injection molding, are produced directly by this same operation.

The studs 116 form, with their lower parts, regions of the tread made of a material having adequate grip characteristics in all use conditions, both in dry weather and in wet weather.

The upper part 114 can be assembled onto the tread 111 not only by injection molding but also by joining the previously formed elements with adhesives, by pouring the part 114 on the tread 111 provided with the membrane 113 inside a mold, or by simple snap-together coupling with waterproofed stitches.

Figure 5:
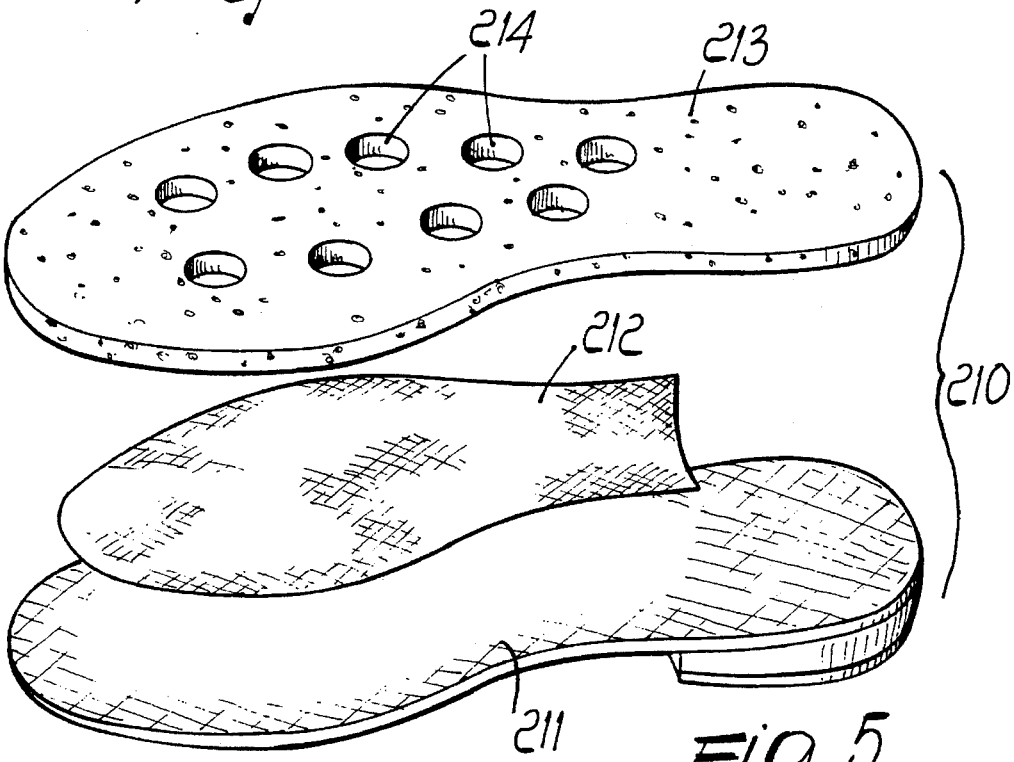
FIG. 5 is an exploded perspective view of a third embodiment of the sole.
Figure 6:
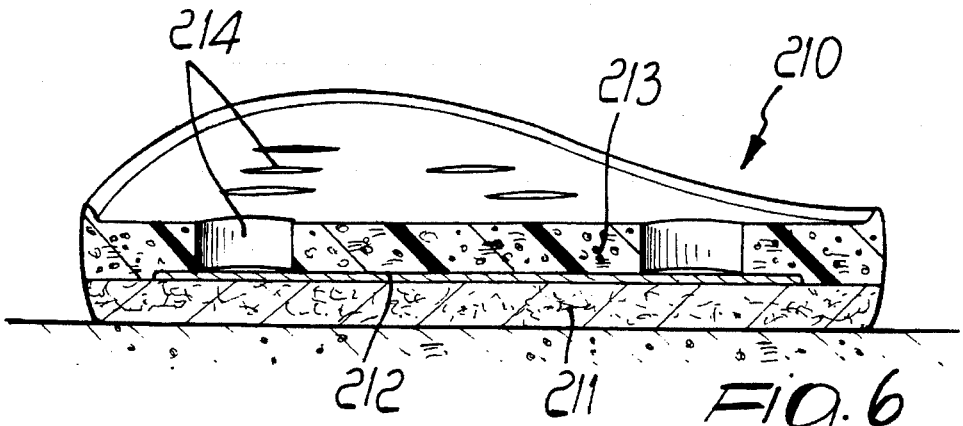
FIG. 6 is a perspective transverse sectional view of the sole of FIG. 5 in assembled condition.

With reference now to the above mentioned FIGS. 5 and 6, in a third embodiment the sole is designated by the reference numeral 210 and comprises a tread 211 made of leather or similar material which is covered, in an upward non-peripheral region, by a membrane 212 which is joined thereto for example by means of adhesives spread in perimetric regions thereof.

A mid-sole 213, made of a soft material such as polyurethane, EVA or equivalent products having shock-absorbing functions, is assembled together with the tread 211 in an upward region.

The mid-sole 213 fully covers the tread 211 even in the region of the membrane 212, indeed because it must perform its shock-absorbing function, but in this central region it has through holes 214 which are suitable to nonetheless allow transpiration from the inside outwards.

In further embodiments of the sole it is possible to combine on the tread a portion with rubber studs in through holes of said tread with a shock-absorbing portion.

In practice it has been observed that the intended aim and objects of the present invention have been achieved.

It is readily understandable from the foregoing, that actually, the new sole is a multilayer sole comprising a first external layer constituted by a leather made tread, a second layer overlapping said first layer so as to cover the plantar region and to leave uncovered the edge region of the tread, the second layer being a membrane of vapour-permeable and waterproof material (as for example the material known by the Trademark "Gore-Tex"), and a third internal layer constituting the upper part. However the membrane, though sealed with the tread and with the upper part at its peripheral region, is arranged so that it is not apparent from the outside of the footgear.

The sole in fact has the qualitative characteristics of leather soles, particularly vapor permeability, together with the qualitative characteristics of soles made of rubber or synthetic material, particularly impermeability.

In its various embodiments, the sole also has antislip and shock-absorbing characteristics.

It should be noted that the sole can be manufactured without particular difficulties with conventional production methods.

The invention thus conceived is susceptible to numerous modifications and variations, all of which are within the scope of the inventive concept.

All the details may furthermore be replaced with other technically equivalent elements.

In practice, the materials employed, so long as they are compatible with the contingent use, as well as the dimensions, may be any according to the requirements.

I claim:

1. Waterproof and transpiring sole for footgear, comprising:

a tread made of a natural material, such as leather, said tread defining an upper surface having an outer perimetric edge region thereof, and a plantar region thereof, said perimetric region encompassing said plantar region;

a membrane of vapour-permeable and waterproof material, said membrane being enclosed by a peripheral region thereof, and being positioned for covering said plantar region of said tread with said peripheral region spaced inwardly from said outer perimetric edge region of said tread, said membrane and said tread being joined by adhesive means spread at said peripheral region of said membrane;

at least one upper part made of waterproof material and having at least one opening at a central region thereof, said upper part being assembled on said tread at said tread edge region so as to overlap said peripheral region of said membrane, and said at least one opening of said upper part leaving exposed said membrane covering said plantar region of said tread; wherein an outer edge sealing of the upper part to the tread at said edge region, an inner sealing of the upper part to the membrane at said peripheral region, and a sealing of the membrane to the tread at said peripheral region are respectively provided for preventing water and moisture from passing in and for letting vapour passing out through the sole.

2. Sole according to claim 1, wherein said upper part made of waterproof material comprises studs, said studs passing through holes provided in said tread for ending substantially at a ground contact level.

3. Sole according to claim 2, wherein said upper part is made of rubber.

4. Sole according to claim 2, wherein said upper part made of waterproof material is assemblable onto said tread by any of injection molding, pouring into a mold, stitching, and gluing.

5. Sole according to claim 1, wherein said upper part is made of a soft shock-absorbing material selectable from a group consisting in polyurethane, and EVA.

6. Sole according to claim 1, wherein said membrane is covered by the upper part constituting a mid-sole element being assembled with said tread at said perimetric region thereof, said mid-sole element being made of a soft shock-absorbing material and comprising through holes located at a central region thereof for opening at said membrane covering said plantar region of said tread, said shock-absorbing material being selectable from a group consisting in polyurethane, and EVA.

7. Sole according to claim 1, wherein said membrane made of vapor-permeable and waterproof material is constituted by a microporous waterproof material.

8. Sole according to claim 1 wherein said at least one through hole of said upper part has tapered edges.

9. A multilayer sole for footgear, comprising:

a first external layer constituted by a leather made tread, said tread comprising an upper surface having an outer edge region, and a plantar region;

a second layer overlapping said first layer so as to cover said plantar region and to leave uncovered said outer edge region, said second layer being a membrane of vapour-permeable and waterproof material, said membrane being enclosed by a peripheral region thereof and being sealingly joined at said peripheral region thereof to said tread; and a third internal layer constituting an upper part, said third layer being made of waterproof material and having at least one opening at a central region thereof, said upper part being sealingly joined to said tread at said tread edge region, and sealed at said peripheral region of said membrane and said at least one opening of said upper part leaving exposed said membrane covering said plantar region of said tread.

10. Sole according to claim 9, wherein said upper part made of waterproof material comprises studs, said studs passing through holes provided in said tread for ending substantially at a ground contact level.

11. Sole according to claim 10, wherein said upper part is made of rubber.

12. Sole according to claim 9, wherein said upper part is made of a soft shock-absorbing material selectable from a group consisting in polyurethane, and EVA.

13. Sole according to claim 9, wherein said membrane is covered by the third layer that being a mid-sole element being assembled with said tread at said edge region thereof, said mid-sole element being made of a soft shock-absorbing material and comprising through holes located at a central region thereof for opening at said membrane covering said plantar region of said tread, said shock-absorbing material being selectable from a group consisting in polyurethane, and EVA.

14. Sole according to claim 9, wherein said membrane made of vapor-permeable and waterproof material is constituted by a microporous waterproof material.

15. Sole according to claim 9, wherein said upper part made of waterproof material is assemblable onto said tread by any of injection molding, pouring into a mold, stitching, and gluing.

16. Sole according to claim 9, wherein said at least one through hole of said upper part has tapered edges.

* * * * *